United States Patent [19]

Spivey

[11] Patent Number: 4,774,389

[45] Date of Patent: Sep. 27, 1988

[54] INTRUSION DETECTOR SWITCH SYSTEM WITH WIRE BRISTLE SWITCH CONTROLS

[76] Inventor: Lewis A. Spivey, 118 Oakcrest Dr., Statesboro, Ga. 30485

[21] Appl. No.: 161,379

[22] Filed: Feb. 22, 1988

Related U.S. Application Data

[63] Continuation of Ser. No. 936,780, Dec. 2, 1986, abandoned.

[51] Int. Cl.[4] ..... H01R 13/54; H01H 3/16

[52] U.S. Cl. ..... 200/164 R; 200/275; 200/61.71; 200/61.93; 200/255; 200/162; 340/545

[58] Field of Search ..... 340/545; 200/16 F, 61.71, 200/61.73, 61.81, 61.93, 164 A, 164 R, 162, 163, 275, 252–256, 260

[56] References Cited

U.S. PATENT DOCUMENTS

| | | | |
|---|---|---|---|
| 2,093,198 | 9/1937 | Kleinmann | 200/275 |
| 2,209,527 | 7/1940 | Knudsen | 200/61.93 X |
| 2,486,042 | 10/1949 | Lesigne | 200/164 R |
| 2,917,612 | 12/1959 | Chabot | 200/254 |
| 3,201,556 | 8/1965 | Baird | 200/282 X |
| 3,684,846 | 8/1972 | McDaniels | 200/61.93 |
| 3,737,591 | 6/1973 | Parlato | 200/61.93 |
| 3,775,575 | 11/1973 | Parlato et al. | 200/61.71 |
| 4,092,506 | 5/1978 | Saulters | 200/61.93 X |
| 4,151,382 | 4/1979 | Kaufman et al. | 200/61.71 |
| 4,392,707 | 7/1983 | Holce et al. | 200/61.71 X |
| 4,556,765 | 12/1985 | Shaw et al. | 200/61.71 |

FOREIGN PATENT DOCUMENTS 1145253 3/1963 Fed. Rep. of Germany ..... 200/282

*Primary Examiner*—Charles E. Phillips
*Assistant Examiner*—Ernest G. Cusick
*Attorney, Agent, or Firm*—Laurence R. Brown

[57] ABSTRACT

The problem of false alarms in a burglar alarm system caused by inadvertent opening of a sensing switch is resolved by providing a burglar alarm system switch with a wire brush contact surface on one switch member of a pair affixed to movable and fixed building parts. The switch parts are so constructed to mate the wire brush as one contact surface in brushing contact with the other switch member contacting surface thereby assuring good contact through any oxidized surface layers. Furthermore, when the switch members are retained in mated closed circuit condition, a significant number of the wire brush members make electric contact to establish the necessary closed conductive path to prevent the burglar alarm from sounding and to maintain it even if slight dimensional changes cause the switch members to move relative to each other. The wire brush contact permits the switch to have greater tolerance to misalignments in installation and occuring after installation in response to various physical movements such as thermal or humidity dimensional changes or forceful changes in position of the building structure from stresses of various kinds.

8 Claims, 1 Drawing Sheet

INTRUSION DETECTOR SWITCH SYSTEM WITH WIRE BRISTLE SWITCH CONTROLS

This application is a continuation of application Ser. No. 936,780 filed Dec. 2, 1986 now abandoned.

TECHNICAL FIELD

This invention relates to burglar alarm systems, and more particularly it relates to a cure for a problem of false alarms occurring in burglar alarm systems that are not caused by unauthorized intruders.

BACKGROUND OF THE INVENTION

A serious problem in burglar alarm systems is the possibility of false alarms. Whether the system sounds a local alarm or is in contact with a security force, such as the local police, there can be little tolerance to false alarms from any source. Such false alarms if possible can destroy the usefulness of a system by creating the classical condition of a boy crying "wolf". One time is too many. Yet little attention is given to resolution of this problem.

Systems that protect against opening or breaking windows or doors are also susceptible to false alarms because they depend upon closure of switch contacts to prevent an alarm. Thus, if a wood window frame shrinks during dry weather, switch contacts may become unaligned and trigger a false alarm. Most such switch contacts are exposed to an oxidizing atmosphere which tends to create an insulation film between two metal switch contacts, particularly after long periods of inactivity such as might occur in a switch protecting a window that is infrequently opened.

When occasional false alarms occur, it is very expensive to maintain and repair alarm systems to assure that they are working properly, because the cause of the false alarm is not easily determinable in many cases. Thus, it is desirable to have a system initially installed more reliably protected against possible false alarms.

It is therefore the object of this invention to provide a reliable burglar alarm system that is less likely to produce false alarms.

BRIEF DESCRIPTION OF THE INVENTION

This invention provides a burglar alarm system of the type having electrical contact switch pairs installed alongside door and windowframes to detect movement of the frames enough to break electrical circuit conductivity established by the switch pairs. This type of system is disclosed for example in U.S. Pat. No. 3,775,575, issued Nov. 27, 1973 to P. J. Parlato, et al. and U.S. Pat. No. 4,556,765 issued Dec. 3, 1985 to A. W. Shaw et al. In these systems the breaking of glass is also detectable by means of detection device(s) placed on the surface of the glass and wired into the circuit with the switch pairs placed respectively on a movable door or window frame and the surrounding framework which is a fixed part of the surrounding building.

I have found by many years research into the existence and false alarm failures of such systems that the primary causes of false alarms are attributable to three causes: (1) oxidation layers created on the switch contact surfaces, (2) physical misalignments that disturb the switch contact surfaces, such as swelling or shrinking of wood frames, settling of the building or other distrortion of the shapes of windows, doors and frames that cause switch contact misalignments and (3) dirt and dust collects on conventional switches which cause a build-up of electrical resistance which in turn will cause alarm malfunctions. In the case of metallic windows or doors such as aluminum, changes of temperature may cause such dimensional changes as to incite false alarms by opening the alarm switch circuit.

To correct these deficiencies, I have developed an improved switch contact pair that resolves substantially all of the possibilities of false alarms from the foregoing three conditions. Thus, one of the two switch surfaces that are electrically contacted when the doors or windows are properly closed and seated is formed with a contact surface area of wire bristles. This contact area is large enough and the bristles are long enough to provide for good electrical contact with a mating blade surface even under various normal degrees of position change due to improper seating or closing of the door or window or shifts due to house settling, shrinking or swelling surfaces, etc.

In a preferred embodiment one contact is in the form of a U-shaped channel into which a mating blade contact is inserted to wipe bristles against opposite surfaces thereof and to make contact at a myriad of positions at the various bristle positions. Thus, it is not likely that an oxidizing layer would either prevent a good initial contact or would be able to disconnect continuity at all of the bristle contact positions on either side of the blade. Furthermore, the dimensioning of the U-shaped channel and the blade thickness and the bristle lengths will permit a considerable amount of the normally expected variations of switch positioning to be tolerated without danger of a false alarm.

A further advantage of this preferred embodiment is that it may be constructed and mounted for use in different door or window movement modes, that is the contact blade may be slid between the U-shape contact members from either the open end of the "U" or from either U-shaped end of the U-shaped member.

Thus, the combination of the aforesaid wire bristle type switch members and a burglar alarm system for the first time produces a system that is less susceptible to false alarms, and thus has a long life without maintenance or switch replacement necessary from time to time in other burglar alarm systems of the type having movable switch sets operable by door and window movement.

BRIEF DESCRIPTION OF THE DRAWINGS

In the accompanying drawings, like reference characters identify similar features in the various views to facilitate comparison.

DESCRIPTION THE PREFERRED EMBODIMENT

Figure 1:
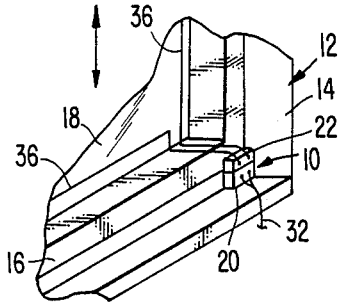
FIGS. 1 and 2 illustrate typical use of switch pairs provided by this invention for detection of the opening of window, sliding of a door or the breaking of glasss.

A typical switch pair 10 installed on the inside of a window assembly 12 moveable vertically up and down in frame 14 when opened and closed as illustrated by the arrow is shown in FIG. 1. The window pane 18 frame portion 16 thus slides within stationary frame 14 along with the pane 18, upon which the conductive breakage detection wire network 36 is placed, preferably as a transparent invisible conductor. It is connected with the switch connection member 22 which is mounted on and thus moves with the window frame portion 16 thereby to separate from the switch connection member 20 affixed to and stationary with the fixed position window frame 14. As the switch members 20 and 22 separate, the electrical contact is broken and an alarm 35 (FIG. 3) is sounded. Similarly the alarm 35 is sounded if the window pane 18 is broken and interrupts the wiring pattern 36 thereon. A pair of wires 32 is connected to the intrusion detection system 34, as well as a corresponding set of wires from any of the other similar switch pairs connected into the system (not shown).

The switch members 20 and 22 separately carry switch contacts which need be connected together when the window 12 is closed and seated to form the alarm circuit for the window 12 which sounds when the window is opened and separates the contact surfaces within switch pair members 20 and 22. The switch housing members 20, 22 may respectively have apertures for mounting screws 40 and 42. The parts in a conventional switch of this type must be very carefully aligned when installed to assure that good contact is made when the window is seated in closed position. As will later be shown the switch structure afforded by this invention is less critical to exact alignment and thus is more tolerant to either inprecise installation or dimensional changes occurring after installation that would tend to cause a poor electrical connection and thereby set off a false alarm.

Figure 3:
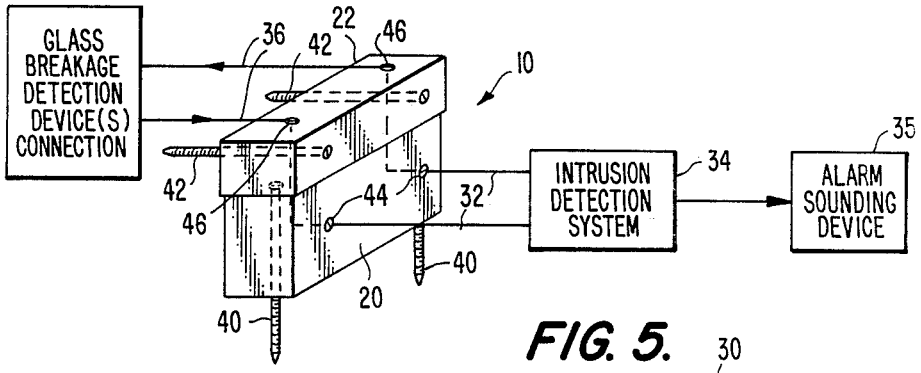
FIG. 3 is a block system diagram illustrating the relationship of one of the detector switch pairs afforded by this invention and the accompanying burglar alarm system, and FIGS. 4 to 6 respectively show in perspective view a female switch member, the U-shaped wire brush switch contact, and a male switch member provided in accordance with this invention.

Also electrical connectors 46 are provided to accommodate the window pane breakage detection function when wired as shown in FIGS. 1 and 3 to the window pane wiring pattern 36. If not used the two connectors 46 are simply wired together and the switch assembly will detect only the mispositioning of the window in its frame to the extent necessary if an unauthorized entry is taking place when the alarm system is turned on. Connectors 44 are similarly provided for connecting the cable wires 32 that communicate with the burglar alarm system 34.

Figure 2:
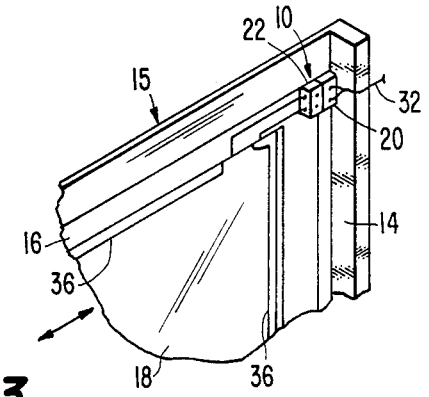

In FIG. 2 a similar installation is illustrated for sliding door assembly 15, wherein the movable frame 16 pulls movable switch member 22 away from the fixed switch member 20 attached to the fixed frame 14. The door frame 16 moves laterally back and forth as indicated by the arrow.

Figure 4:
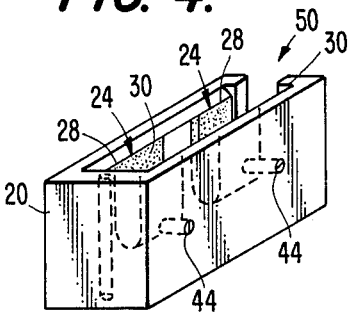
Figure 5:
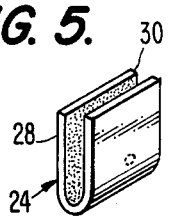
Figure 6:
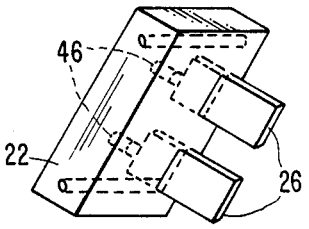

The preferred switch construction embodiment is shown in FIGS. 4 to 6. Thus, the fixed switch member 20 of the switch pair comprises a female member having a pair of U-shaped switch contact members forming a female receptacle 24 for mating a corresponding pair of male blade members 26 thereinto as the two switch body members are moved together into mating contact. The female member has a metallic panel of good electrical conduction characteristic with its surface embedded with wire bristles and bent into the U-shape of FIG. 5. Thus the blades 26 are contacted in a brushing action on both sides as the two switch members are mated for removing any oxidation and assuring good electrical contact by a multiplicity of wire brush elements 30.

If any movement occurs between the two switch members while the alarm is turned on, such as caused by thermal expansion of metal or by swelling or shrinking of wood, or by settling of a building, the wire brush contact structure will not be conducive to opening the alarm circuit as may be the case when oxidized planar surfaces are present in conventional switches. Similarly the tolerance of this switch to variations of alignment and seating of the window and door frames will assure good conductivity even if the blades 26 are not fully inserted, or if they are slightly misaligned in any direction.

Note that in FIG. 4, the female switch member 20 has a notch 50 into which the male blades 26 may be laterally entered so that a single configuration could be used for mating of the switch members from either of two normally disposed directions. Also note that an advantage of this embodiment is that there need not be enough clearance between the switch members 20 and 22 to withdraw the male blades 26 out of the female member 20 in the direction away from the open end of the U-shaped members 28 by separation of the parts 20 and 22. Thus this switch member is adaptable to a wide variety of mounting conditions.

Novel switching structure for detection of unauthorized movement of door or window openings away from a predetermined secure position and/or breakage of glass is thus afforded by this invention. The switch has two juxtapositionable members respectively mounted on moving and fixed parts of windows or doors for completing, when in mated contact, an electrical conductor path in the burglar alarm system necessary to prevent sounding an alarm. The members define a mating path, preferably of male-female character, for causing one electrical contact to brush against another in surface contact with a brush-like set of wires which penetrate oxidized surfaces and provide in a mated retaining position electrically conductive contact by means of a significant number of brush-like wires, until the two contacts are moved apart out of contact by window or door movement.

In essence therefore the problem of false alarms is significantly solved by means of the special switch structure causing a switch member having a blade like contact surface mating with a wire brush contact surface on another switch member. This prevents the deterioration of switch contact surfaces by oxidation from causing false alarms and assures conductive contact of a plurality of wires at various positions in a manner that is reliable even with slight misregistrations and with minor movements that are not caused by intruders opening windows or doors or breaking glass.

It is clear therefore that the propensity for false alarms in a window-door conductive contact switch type of intruder alarm system is considerably decreased by this invention. Therefore those features of novelty descriptive of the nature and spirit of the invention are defined with particularity in the following claims, for which Letters and Patent are petitioned.

I claim:

1. An intrusion detection system comprising in combination, electrically conductive switching means located to sense intrusion by detecting unauthorized movement of a movable door or window away from a predetermined secure position abutting a frame by interrupting an electrical conductor path of an electrical alarm circuit, two switch members respectively carrying mating electrical contacts positioned on said frame and on the door or window for movement into mating electrical contact for completing said electrical conductor path when the frame abuts the door or window and for causing movement of the members to break the conductor path when the door or window moves away from its position abutting said frame, and electrically contacting structure carried by the respective mating electrical contacts comprising a plurality of conductive brushlike wire bristles and a mating surface against which the bristles need be wiped in a movement path to establish contact and against which a plurality of the bristles rest in electrically conductive contact in said position abutting the frame until the two switch members are moved apart to break said conductor path, whereby the mating contacts will make electrical contact over a normally encountered variation of alignment of the door or window with the frame and will maintain closed electrical contact for long periods of time with the brushlike wire bristles in physical contact with said mating surface without the likelihood of opening the electrical conductor path due to oxidation of the contacts.

2. The system defined in claim 1 further comprising: a first of the mating electrical contacts comprising a platelike element having two opposite surfaces, and the second of said mating electrical contacts comprising a wirebrushlike structure with bristles for engaging the platelike element on the two opposite surfaces with a plurality of bristles to establish electrical contact.

3. The system defined in claim 1 further comprising: one of said switch members carrying the conductive brushlike wire bristles having two normally disposed mating openings therein for entry thereinto of the first contact into mating position with the brushlike wire bristles from either of two respective normal directions.

4. In a switch assembly for an alarm system of the type which electrically connects two switch contacts when a movable structure is in a secure position against a frame member having a first switch member carrying one electrically conductive contact of a pair of mating contacts for mounting on said movable structure, and a second switch member carrying the other mating contact of said pair for positioning on said frame member, with said switch members carrying respective switch contact structures being relatively positionable for mounting respectively with said switch members on said movable structure and frame member in a mating electrical contact position for establishing electrical contact through a breakable conductive path, the improvement comprising in combination, one of said switch contact structures comprising a platelike member with a planar contact surface thereon, the other of said switch contact structures comprising a wire brushlike element having a plurality of wire bristle contact members positionable adjacent to the platelike contact surface to attain a mating electrical contact position in said secure position by deformably wiping the wire bristle contact members across said planar surface to attain said mating contact position when the movable structure abuts the frame member.

5. The switch assembly defined in claim 4 further comprising, said wire brushlike element having electrical contact structure presenting a plurality of wire bristle contact members disposable on opposite sides of said platelike member, said platelike member further presenting two of said planar contact surfaces on opposite sides thereof for the respective wire bristle contact members to brush across in attaining said mating contact position.

6. The switch assembly defined in claim 5 further comprising, said wire brushlike element forming an open-ended U-shaped member.

7. The switch assembly defined in claim 5 further comprising, said first and second switch members each having two separate electrical contact elements for mating together in said mating contact position, and connector terminals from the contacts on said first switch member adapted for connecting with a glass breakage detection circuit in the movable structure.

8. The switch assembly defined in claim 4 further comprising, a housing for said other of the switch members containing the wire brushlike element presenting two mating openings for entry of said platelike member into mating electrical contact with the wire bristle contact members from either of two normal directions into the respective two mating openings.

* * * * *